US011081839B2

(12) United States Patent
Kawamoto et al.

(10) Patent No.: US 11,081,839 B2
(45) Date of Patent: Aug. 3, 2021

(54) CONNECTOR WITH HIGH RELIABILITY OF RETURNING A PROTECTION MEMBER TO A PARTIAL LOCKING POSITION

(71) Applicant: Sumitomo Wiring Systems, Ltd., Yokkaichi (JP)

(72) Inventors: Masami Kawamoto, Yokkaichi (JP); Ryotaro Kosaka, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/824,762

(22) Filed: Mar. 20, 2020

(65) Prior Publication Data

US 2020/0303877 A1 Sep. 24, 2020

(30) Foreign Application Priority Data

Mar. 22, 2019 (JP) ..... JP2019-054293

(51) Int. Cl.
*H01R 13/639* (2006.01)
*H01R 13/629* (2006.01)
*H01R 13/453* (2006.01)

(52) U.S. Cl.
CPC ..... *H01R 13/639* (2013.01); *H01R 13/4538* (2013.01); *H01R 13/62966* (2013.01)

(58) Field of Classification Search
CPC ..... H01R 13/639; H01R 13/62966; H01R 13/4538; H01R 13/502; H01R 13/64
See application file for complete search history.

(56) References Cited

U.S. PATENT DOCUMENTS

| | | | | |
|---|---|---|---|---|
| 10,826,238 | B2 * | 11/2020 | Ochiai | H01R 13/62927 |
| 2016/0079699 | A1 | 3/2016 | Kobayashi et al. | |
| 2016/0164215 | A1 * | 6/2016 | Bang | H01R 13/4538 439/660 |
| 2017/0346230 | A1 * | 11/2017 | Imai | H01R 33/7671 |

FOREIGN PATENT DOCUMENTS

| | | | |
|---|---|---|---|
| JP | 2017-188244 | | 10/2017 |
| JP | 2017188244 A | * | 10/2017 |
| WO | 2014/192800 | | 12/2014 |

* cited by examiner

*Primary Examiner* — Travis S Chambers
(74) *Attorney, Agent, or Firm* — Gerald E. Hespos; Michael J. Porco; Matthew T. Hespos

(57) ABSTRACT

A connector has a protection member movable to a partial locking position and a full locking position with a male tab positioned in a receptacle of a male housing. The female housing includes a hook, and the protection member includes a hooked portion capable of contacting the hook at the full locking position. The receptacle includes a contact portion capable of contacting the hooked portion when the protection member is at the partial locking position. The protection member is movable from the full locking position to the partial locking position with the hooked portion held in contact with the hook. The protection member is stoppable at the partial locking position in a state where the hooked portion is in contact with the contact portion to be deflected in a direction separating from the hook.

7 Claims, 11 Drawing Sheets

CONNECTOR WITH HIGH RELIABILITY OF RETURNING A PROTECTION MEMBER TO A PARTIAL LOCKING POSITION

BACKGROUND

Field of the Invention

This disclosure relates to a connector.

Related Art

WO 2014/192800 discloses a connector assembly with a female connector, a protection member, and a male connector. The protection member is moved to a partial locking position where the protection member is disposed temporarily with respect to the male connector and a state where the protection member is pressed by the female connector and completely disposed together with the female connector. The protection member includes an engaged portion composed of a resilient arm and a claw on a tip part of the resilient arm.

Japanese Unexamined Patent Publication No. 2017-188244 discloses a connector assembly where a protrusion of the female connector contacts a claw of the protection member and moves the protection member if the female connector moves in a direction to separate from the male connector. If the female connector moves farther, the resilient arm is deformed resiliently out, the claw is separated from the protrusion, and the protection member can return to the partial locking position.

WO 2014/192800 discloses a connector assembly where a hooked state of the protrusion and the claw is released when the female connector is separated from the male connector. The protection member cannot be stopped at the partial locking position and may inadvertently be detached from the male connector.

Accordingly, it is aimed to provide a connector having a high reliability in returning a protection member to a partial locking position.

SUMMARY

This disclosure is directed to a connector with a male housing including a receptacle, a male tab configured to project into the receptacle, a protection member arranged in the receptacle, and a female housing to be inserted into the receptacle. The protection member is movable to a partial locking position and a full locking position located more backward in the receptacle than the partial locking position when the male tab is positioned. The female housing includes a hook, and the protection member includes a hooked portion capable of contacting the hook in an escaping direction of the female housing from the receptacle when the protection member is at the full locking position. The receptacle includes a contact portion capable of contacting the hooked portion in an escaping direction of the protection member from the receptacle when the protection member is at the partial locking position. The protection member is movable from the full locking position to the partial locking position with the hooked portion held in contact with the hook, and the protection member is stoppable at the partial locking position in a state where the hooked portion is in contact with the contact portion to be deflected and deformed in a direction separating from the hook.

The protection member is stoppable at the partial locking position in a state where the hooked portion is in contact with the contact portion to be deflected and deformed in a direction separating from the hook. The hooked portion remains in contact with the hook in the process of separating the female housing from the male housing so that the protection member moves from the full locking position toward the partial locking position. Thereafter, the hooked portion contacts the contact portion and is deflected away from the hook. The protection member can be stopped accurately at the partial locking position and the contact portion can separate the hooked portion forcibly from the hook.

The hooked portion and the contact portion may include slopes inclined to separate the hooked portion from the hook with respect to a moving direction of the protection member from the full locking position to the partial locking position and capable of sliding against each other. According to this configuration, the hooked portion reliably deflects and deforms along the slopes when separating the hooked portion from the hook, thereby reliably keeping the protection member at the partial locking position.

The hooked portion may resiliently return from the deflected and deformed state and may enter a state to contact the contact portion. The escape of the protection member from the receptacle is restricted by the contact of the hooked portion with the contact portion. Thus, the contact portion has a function of separating the hooked portion from the hook and a function of restricting the escape of the protection member.

The protection member may include a stopped portion that is separate from the hooked portion, and the receptacle may include a stopper capable of contacting the stopped portion in the escaping direction of the protection member from the receptacle. According to this configuration, even if the hooked portion is deflected inadvertently and separated from the contact portion when the protection member is at the partial locking position, the escape of the protection member from the receptacle is restricted by the contact of the stopped portion with the stopper. Therefore, the escape of the protection member is restricted with enhanced reliability.

The hooked portion and the hook may be formed to contact each other perpendicularly to the moving direction of the protection member from the full locking position to the partial locking position or along a direction at an acute angle to the moving direction. This configuration, reliably maintains the contact state of the hooked portion with the hook in the process of separating the female housing from the male housing. Therefore, the hooked portion is not disengaged inadvertently from the hook in the process of bringing the hooked portion into contact with the contact portion and deflecting and deforming the hooked portion.

According to the disclosure, the connector has a high reliability in returning a protection member to a partial locking position.

An example of the connector of the disclosure is described below with reference to the drawings. The invention is not limited to these illustrations and is intended to be represented by claims, including all changes in the scope of claims and in the meaning and scope of equivalents.

DETAILED DESCRIPTION

Figure 1:
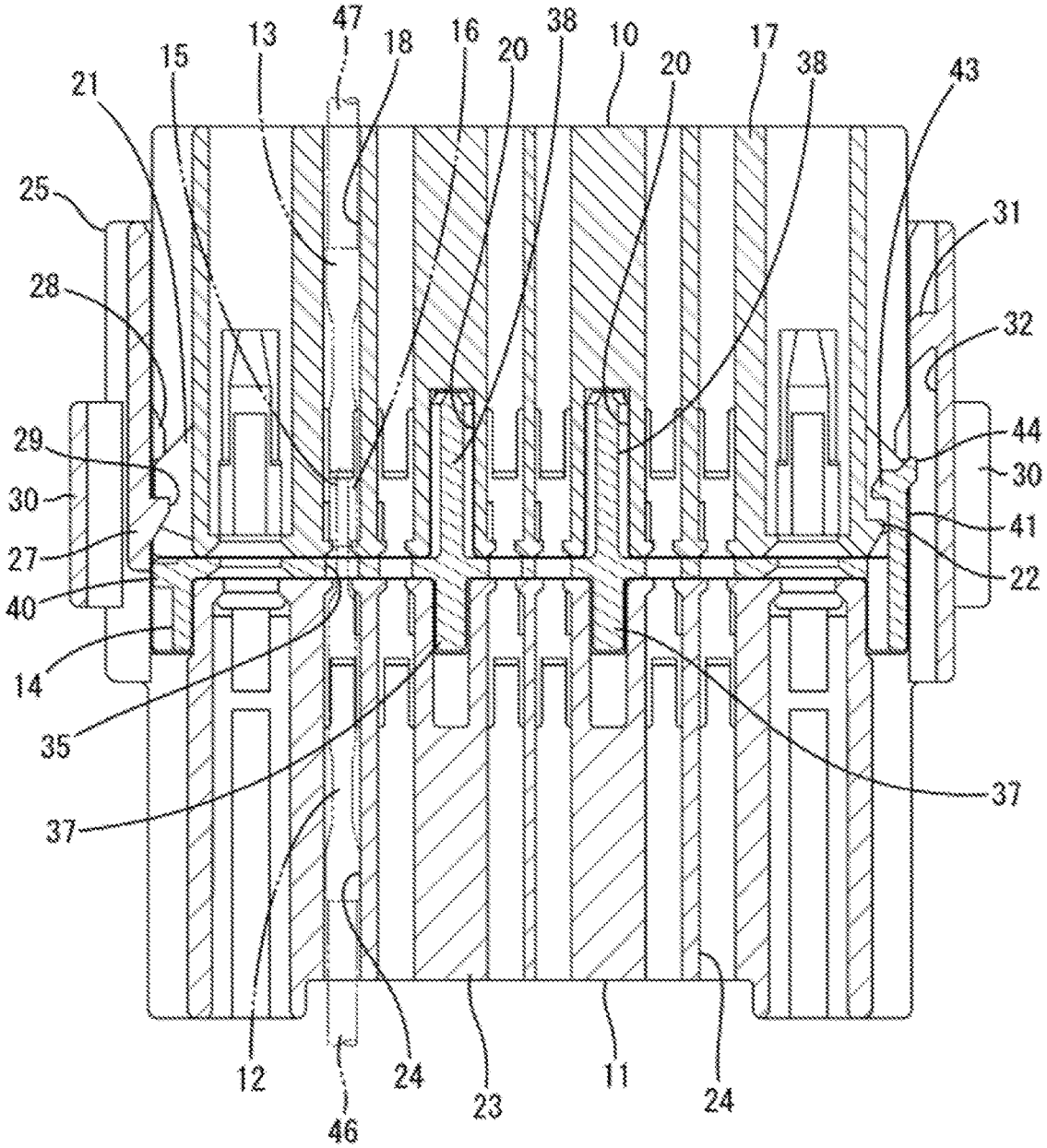
FIG. 1 is a section showing a properly connected connector according to an embodiment.

A connector of this embodiment includes a female housing 10 and a male housing 11 connectable to each other, male terminal fittings 12 to be mounted into the male housing 11, female terminal fittings 13 to be mounted into the female housing 10 and a protection member 14 movably provided in the male housing 11, as shown in FIG. 1. Note that, in the following description, surface ends facing each other when the connection of the housings 10, 11 is started are referred to as front ends concerning a front-rear direction. The protection member 14 follows front and rear references of the male housing 11.

Male Terminal Fittings 12 and Female Terminal Fittings 13

The male terminal fitting 12 is made of conductive metal and, as shown in FIG. 1, connected to an end part of a wire 46. The male terminal fitting 12 includes a male tab 15 projecting forward. The female terminal fitting 13 also is made of conductive metal and is connected to an end part of a wire 47. The female terminal fitting 13 includes a box-like connecting portion 16, and the male tab 15 is inserted into the connecting portion 16 when the both housings 10, 11 are connected properly. The male tab 15 is connected conductively to the female terminal fitting 13 inside the connecting portion 16.

Female Housing 10

Figure 5:
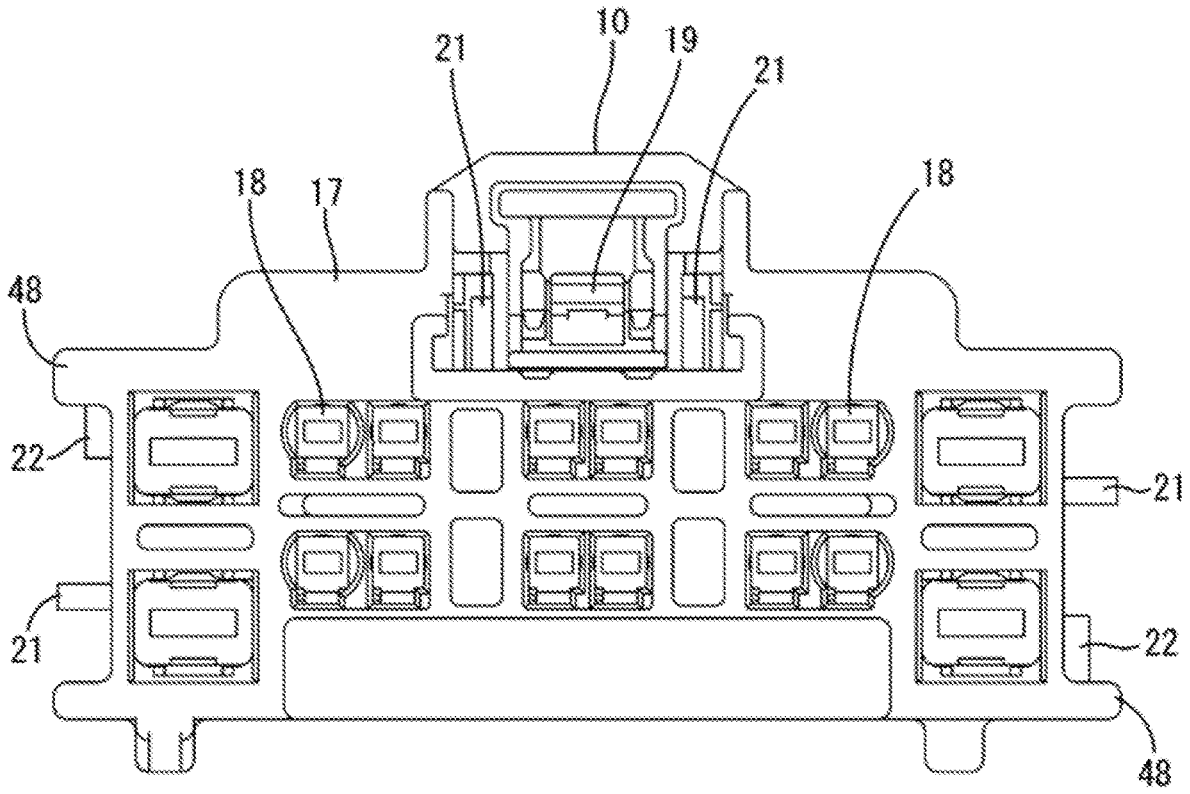
FIG. 5 is a back view of the female housing.

The female housing 10 is made of synthetic resin and includes, as shown in FIGS. 1 and 5, a female housing body 17 in the form of a wide rectangular block. The female housing body 17 includes female cavities 18, and the female terminal fittings 13 are inserted respectively into the female cavities 18 from behind. As shown in FIG. 5, a deflectable and deformable lock arm 19 projects from a laterally central part of the upper surface of the female housing body 17. As shown in FIG. 1, left and right slit grooves 20 open in a laterally central part of a front surface of the female housing body 17.

Figure 2:
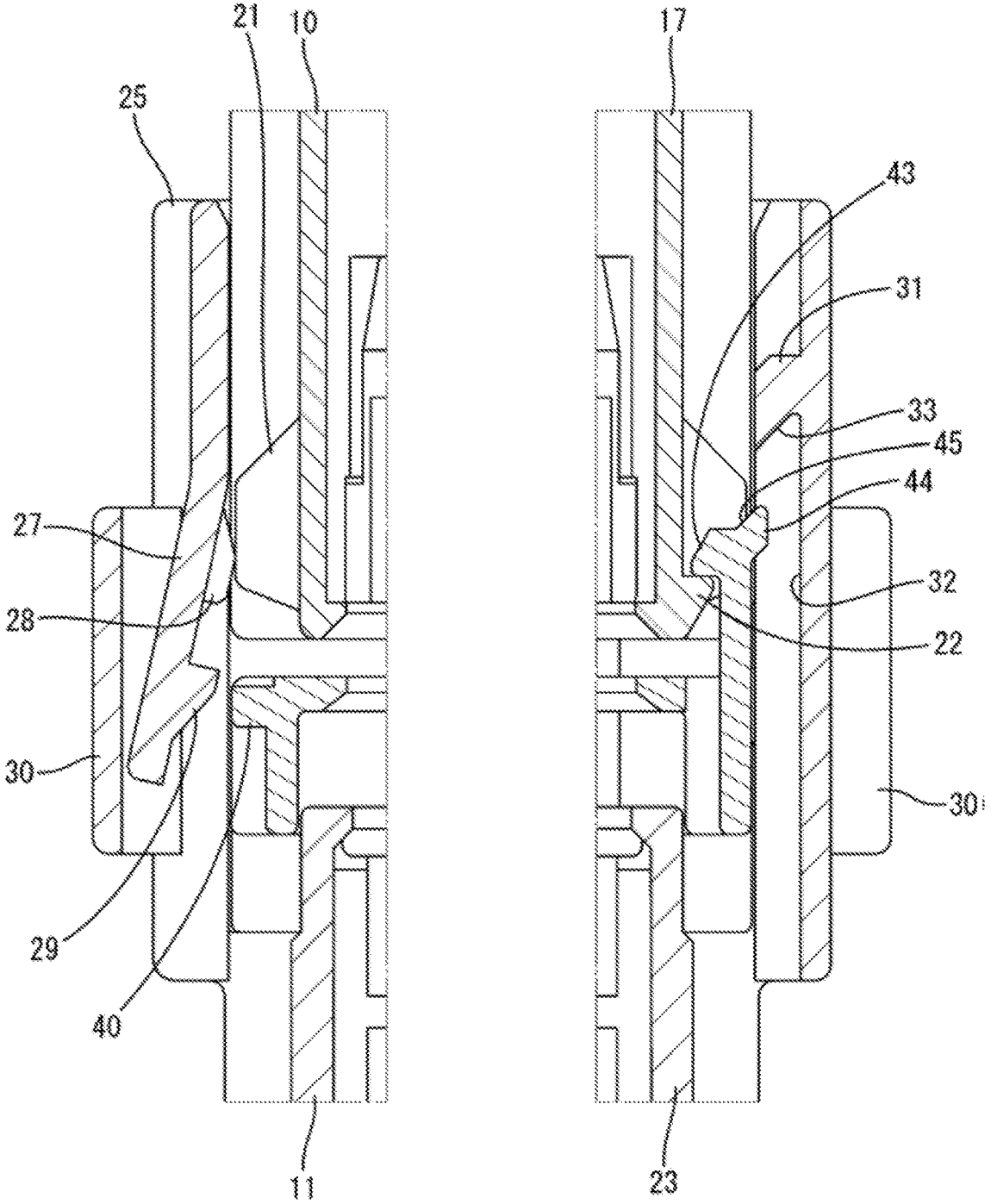
FIG. 2 is an enlarged section showing a state where a hooked portion is in contact with a hooking portion and a state where a front stopper portion is on a releasing portion when a female housing moves in an escaping direction from a receptacle from the state of FIG. 1.

As shown in FIG. 5, releasing portions 21 are arranged respectively on a lower part of the right side surface of the female housing body 17 (left side surface in FIG. 5 since FIG. 5 is a back view) and an upper part of the left side surface of the female housing body 17 while being deviated in the vertical direction. Each of the releasing portions 21 is a projecting plate, as shown in FIGS. 1 and 2. The tip surface of each releasing portion 21 is straight along the front-rear direction. The front end of each releasing portion 21 is inclined rearward toward the tip, and the rear end of the releasing portion 21 is inclined forward toward the tip. The female housing 10 also includes two releasing portions 21 similar to the above on both left and right sides of the front end of the lock arm 19 (see FIG. 5). Although not shown in detail, the releasing portions 21 are integral to the front ends of side wall parts provided on both left and right sides of the lock arm 19.

The female housing 10 includes two hooks 22 on the left and right side surfaces of the female housing body 17. The hooks 22 are arranged respectively on an upper part of the right side surface (left side surface in FIG. 5 since FIG. 5 is a back view) and a lower part of the left side surface of the female housing body 17 while being deviated in the vertical direction. The hooks 22 are coupled integrally to ribs 48 protruding laterally on the upper and lower ends of the female housing body 17. Each hook 22 is in the form of a claw projecting on the front end of the left or right surface of the female housing body 17. A vertical dimension of each hook 22 is larger than that of the releasing portion 21. A dimension in the front-rear direction of each hook 22 is smaller than that of the releasing portion 21. As shown in FIGS. 1 and 2, the front surface of the hook 22 is inclined rearward toward a tip, while the rear surface of the hook 22 is perpendicular to the front-rear direction.

Male Housing 11

The male housing 11 is made of synthetic resin and includes a male housing body 23 in the form of a wide rectangular block. As shown in FIG. 1, the male housing body 23 includes male cavities 24, and parts of the male terminal fittings 12 except the male tabs 15 are accommodated respectively in the male cavities 24.

A receptacle 25 projects forward from the outer edge of the male housing body 23. The receptacle 25 is a wide rectangular tube one size larger than the male housing body 23.

Figure 10:
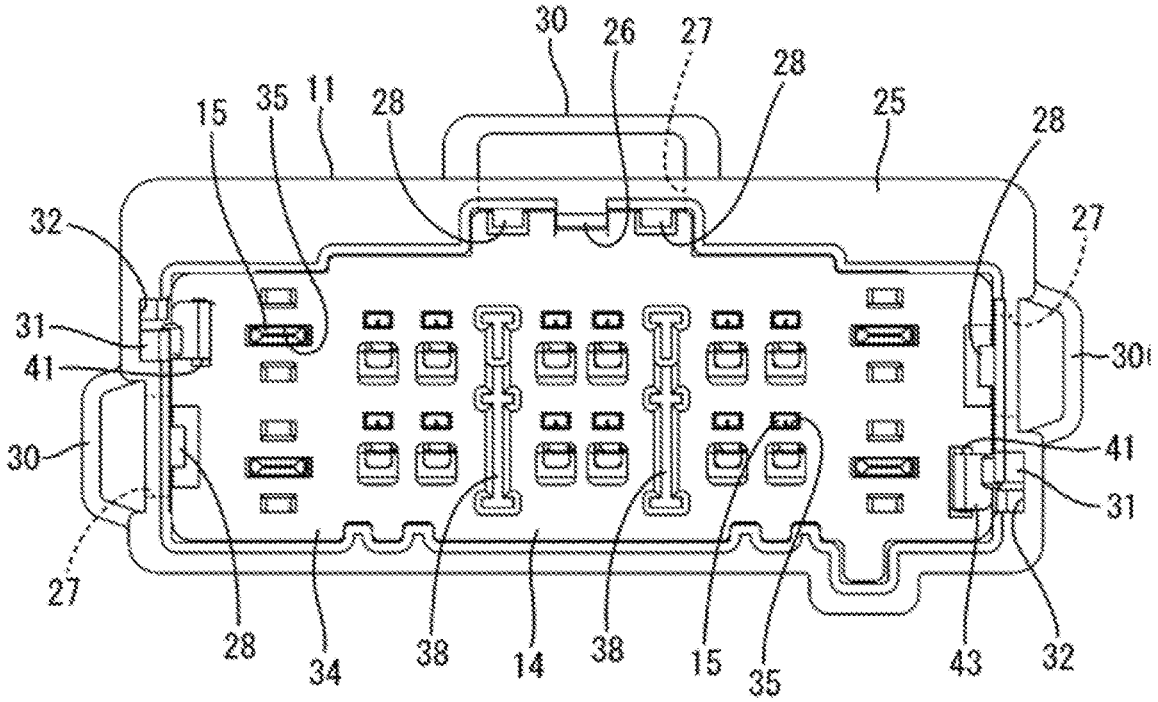
FIG. 10 is a front view showing a state where the protection member is held at the partial locking position with respect to the male housing.

The male tabs 15 of the respective male terminal fittings 12 project into the receptacle 25. Further, the female housing 10 can fit into the receptacle 25. The receptacle 25 includes a lock 26 on the inner surface (lower surface) of an upper wall, as shown in FIG. 10. The lock 26 is in the form of a claw projecting into the receptacle 25 from a front part of a laterally central part of the inner surface of the upper wall. The lock 26 is locked to the lock arm 19 when the housings 10, 11 are connected properly.

Figure 6:
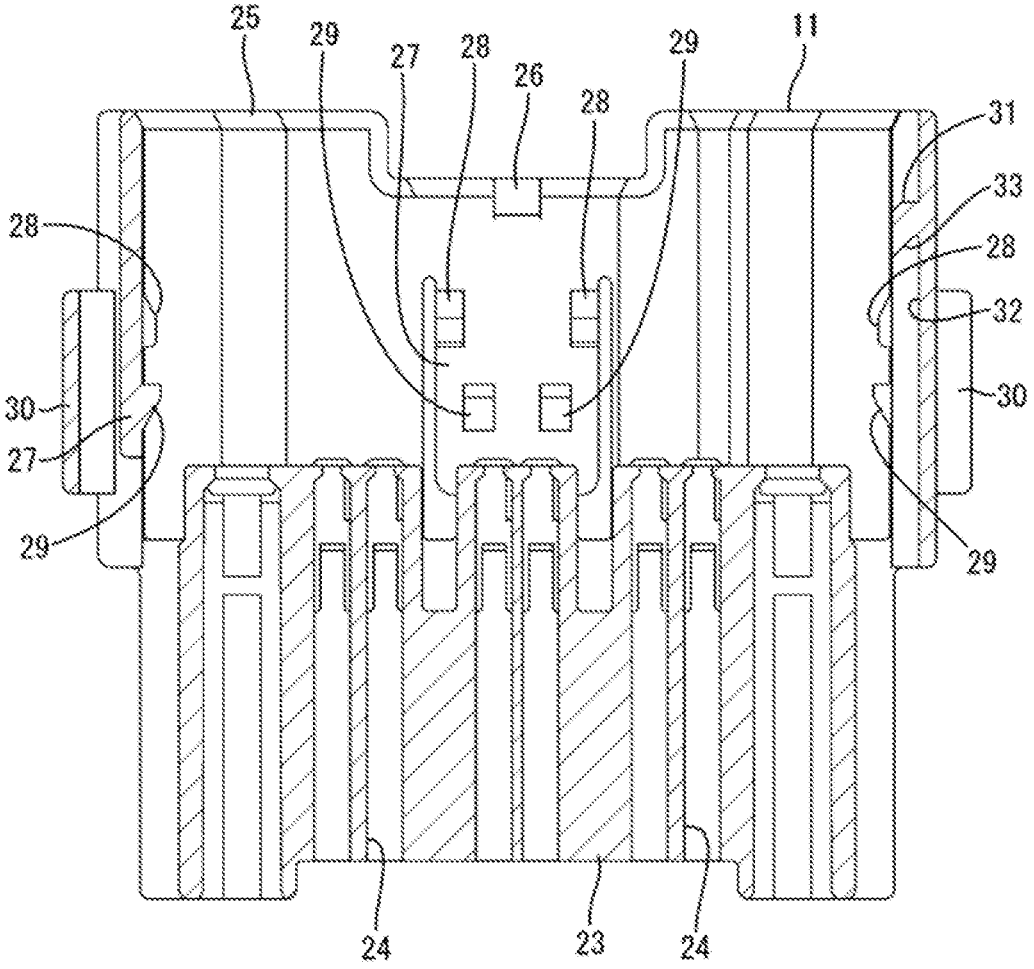
FIG. 6 is a section of a male housing.

As shown in FIG. 6, the receptacle 25 includes a U-shaped cutout behind the lock 26 in the upper wall, and a deflecting portion 27 inside the cutout. The deflecting portion 27 is a rectangular plate that is deflectable and deformable in the vertical direction with a front of the upper wall of the receptacle 25 as a fulcrum.

Two front stoppers 28 are arranged on left and right sides near a front part of the deflecting portion 27. Each of the front stoppers 28 is in the form of a claw projecting into the receptacle 25 from the inner surface of the deflecting portion 27. The tip surface of each front stopper 28 is straight along the front-rear direction. The front surface of each front stopper 28 is inclined rearward toward the tip surface (see stoppers 28 (to be described later) provided on the left and right surfaces of the receptacle 25 in FIG. 6). The rear surface of each front stopper 28 is perpendicular to the front-rear direction.

Two rear stoppers 29 are arranged on both left and right sides near a rear end part (free end part) of the deflecting portion 27. The rear stoppers 29 are deviated toward a lateral center with respect to the front stopper portions 28. Each of the rear stoppers 29 is in the form of a claw projecting into the receptacle 25 from the inner surface of the deflecting portion 27. The tip surface of each rear stopper 29 is straight along the front-rear direction. The front surface of each rear stopper 29 is perpendicular to the front-rear direction (see stoppers 29 (to be described later) provided on the left and right side surfaces of the receptacle 25 in FIG. 6). The rear surface of each rear stopper 29 is inclined rearward toward the tip surface. As shown in FIG. 10, the receptacle 25 includes a U-shaped cover 30 covering the outer surface (upper surface) of the deflecting portion 27 on the upper wall.

As shown in FIG. 6, the receptacle 25 includes deflecting portions 27 and the front and rear stoppers 28, 29 similar to the above on left and right side walls. The deflecting portions 27 and the front and rear stoppers 28, 29 are shaped similarly to those on the upper wall and as described above. The deflecting portions 27 on the left and right side walls (deflecting portions 27 on both left and right sides) respectively have a smaller plate width than that provided on the upper wall (upper deflecting portion 27). The plate width of the left and right deflecting portions 27 is a vertical dimension, and that of the upper deflecting portion 27 is a lateral dimension. One front stopper 28 and two of the rear stoppers 29 located above and below the front stopper 28 project on each of the deflecting portions 27 on both left and right sides.

As shown in FIG. 10, the right deflecting portion 27 is arranged near an upper end on the right side wall of the receptacle. The left deflecting portion 27 is arranged near a lower end on the left side wall of the receptacle 25. Thus, the left and right deflecting portions 27 are arranged on the left and right side walls of the receptacle 25 while being deviated in the vertical direction. The receptacle 25 includes U-shaped covers 30 for respectively covering the outer surfaces (side surfaces) of the left and right deflecting portions 27 on the left and right side walls.

The receptacle 25 includes two contact portions 31 on the left and right side walls. As shown in FIG. 10, the right contact portion 31 is arranged on a lower part of the right side wall of the receptacle 25. The left contact portion 31 is arranged on an upper part of the left side wall of the receptacle 25. Thus, the contact portions 31 are arranged on the left and right side walls of the receptacle 25 while being deviated in the vertical direction. Further, the right contact portion 31 is arranged below and side by side with the right deflecting portion 27 on the right side wall of the receptacle 25. The left contact portion 31 is arranged above and side by side with the left deflecting portion 27 on the left side wall of the receptacle 25.

As shown in FIG. 6, the contact portions 31 are provided in two grooves 32 (only one is shown in FIG. 6) provided in the inner surfaces of the left and right side walls. The grooves 32 extend in the front-rear direction in the inner surfaces of the left and right side walls. The inner surface of each groove 32 has a groove back surface located outwardly of a reference surface (inner surface of the deflecting portion 27) along the vertical direction on the inner surface of the side wall and step surfaces located between the upper and lower ends of the groove back surface and the reference surface. As shown in FIG. 10, the right contact portion 31 is a block projecting integrally with the groove back surface and the upper step surface of the groove 32 in the lower part of the right side wall. The left contact portion 31 is a block projecting integrally from the groove back surface and the lower step surface of the groove 32 in the upper part of the left side wall.

The contact portions 31 are arranged at intermediate positions in the front-rear direction in front of the deflecting portions 27 in the grooves 32. As shown in FIG. 6, the tip surface of the contact portion 31 is arranged along the front-rear direction and connected to the reference surface of the left or right side wall without any step. The front surface of the contact portion 31 is perpendicular to the front-rear direction. The rear surface of the contact portion 31 is inclined rearward toward the tip surface. Specifically, the rear surface of the contact portion 31 is formed into a slope 33 arranged in an overhanging manner from the groove back surface to the tip surface to be at an acute angle to the groove back surface of the groove 32.

Protection Member 14

Figure 7:
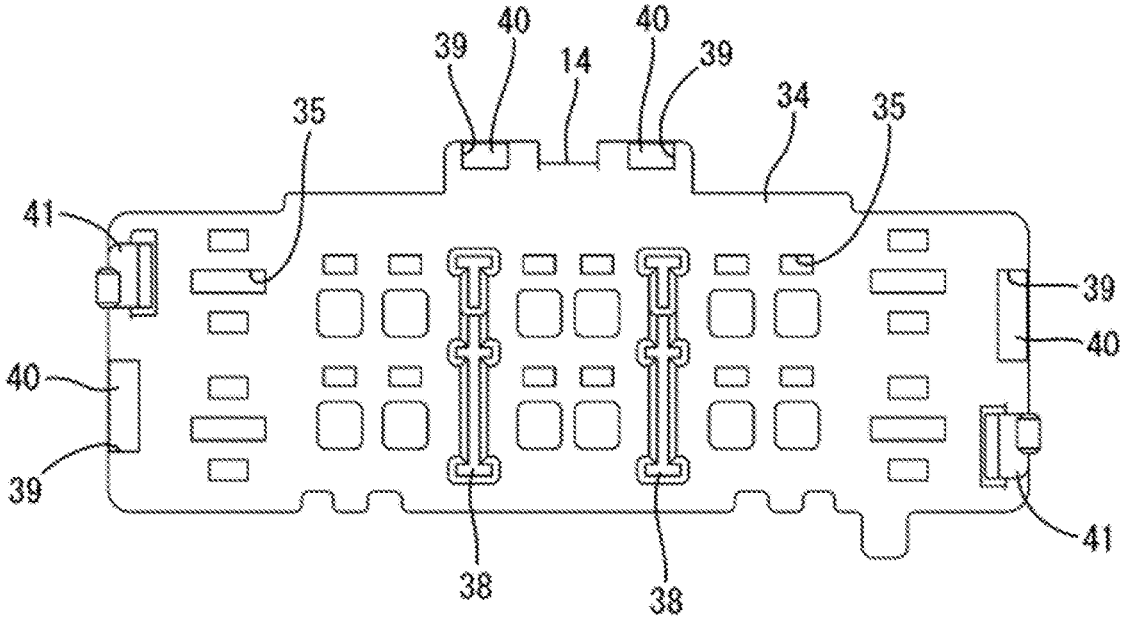
FIG. 7 is a front view of the protection member.
Figure 8:
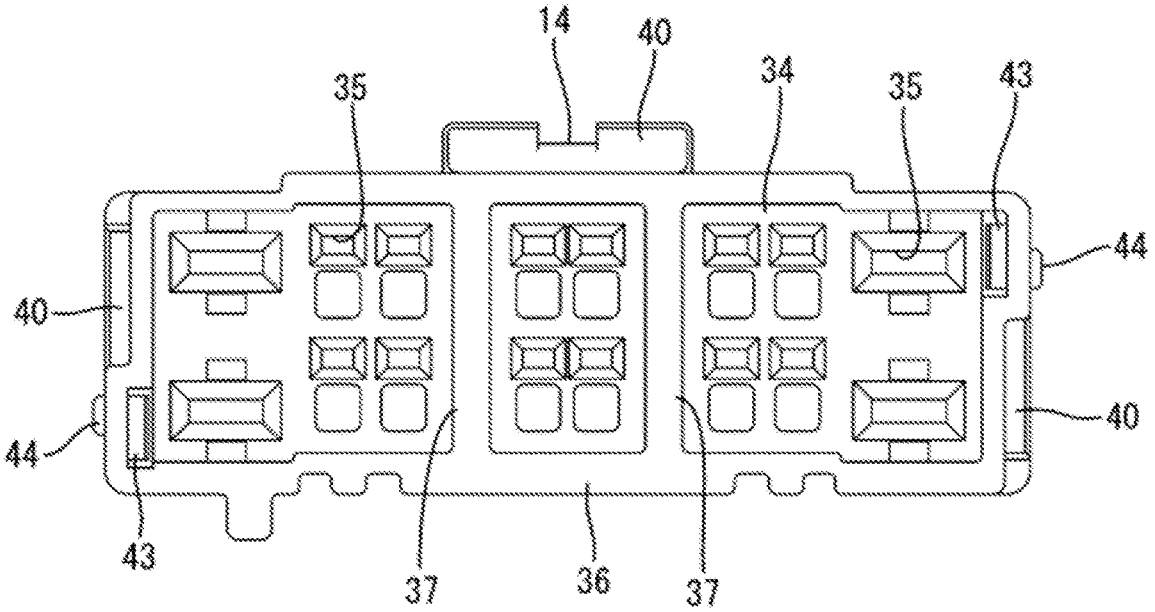
FIG. 8 is a back view of the protection member.

The protection member 14 is made of synthetic resin and is incorporated movably to a partial locking position (see FIGS. 4, 10, 11 and 12) and the full locking position (see FIG. 1) in the receptacle 25. As shown in FIGS. 7 and 8, the protection member 14 includes a protection wall 34 in the form of a wide flat rectangular plate. As shown in FIG. 10, the protection wall 34 is dimensioned and configured to close an opening of the receptacle 25. The protection wall 34 includes positioning holes 35, and the male tabs 15 of the male terminal fittings 12 are positioned and inserted through the respective positioning holes 35 of the protection wall 34.

As shown in FIG. 8, the protection member 14 includes a tubular peripheral wall 36 projecting rearward from the outer edge of the protection wall 34. The protection member 14 includes two vertical ribs 37 projecting rearward from the rear surface of the protection wall 34. The vertical ribs 37 extend in the vertical direction in a laterally central part of the rear surface of the protection member 14, and the upper and lower ends thereof are connected integrally to upper and lower wall parts of the peripheral wall 36. As shown in FIG. 7, the protection member 14 includes two projecting pieces 38 projecting forward from the front surface of the protection wall 34. The projecting pieces 38 are vertical plates arranged at positions opposite to the vertical ribs 37 across the protection wall 34, as shown in FIG. 1. The projecting pieces 38 cover the male tabs 15 of the respective male terminal fittings 12 and are fit into the slit grooves 20 when the housings 10, 11 are connected properly.

Figure 9:
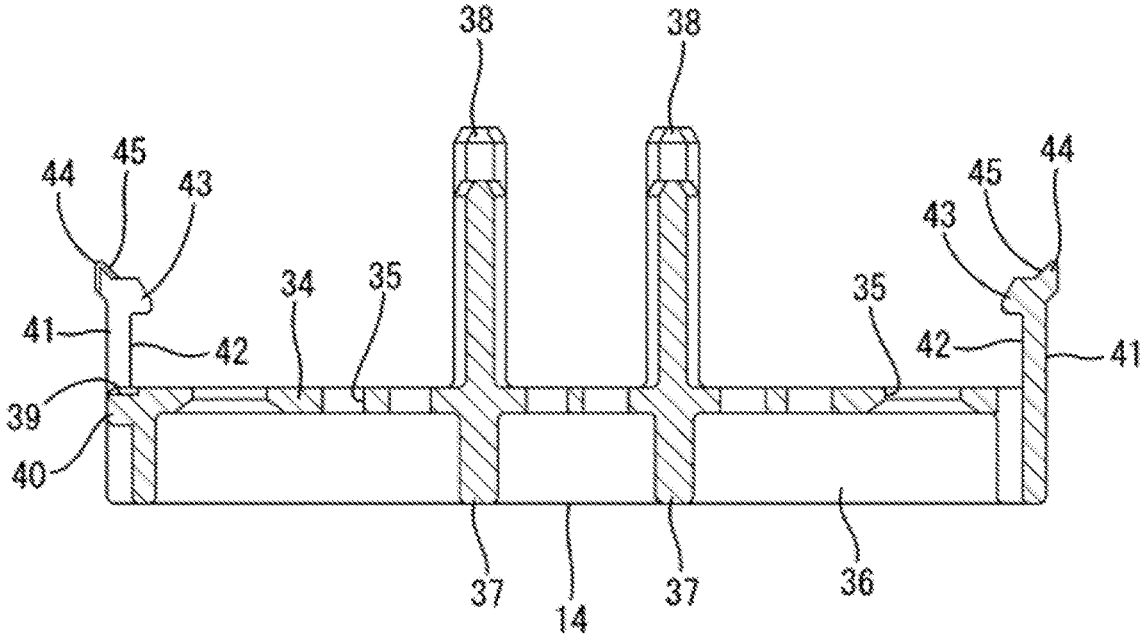
FIG. 9 is a section of the protection member.

As shown in FIG. 7, recesses 39 are formed on both left and right sides of the front surface of the protection wall 34 and are rectangular in front view. The right recess 39 is in an upper part of a right edge of the protection wall 34, and the left recess 39 is in a lower part of a left edge of the protection wall 34. The protection member 14 has two stopped portions 40 (only one is shown in FIG. 9) in parts reduced in plate thickness by the recesses 39 on the left and right sides of the protection wall 34. As shown in FIG. 8, left and right side walls of the peripheral wall 36 include parts bent inwardly not to overlap the stopped portions 40.

Figure 12:
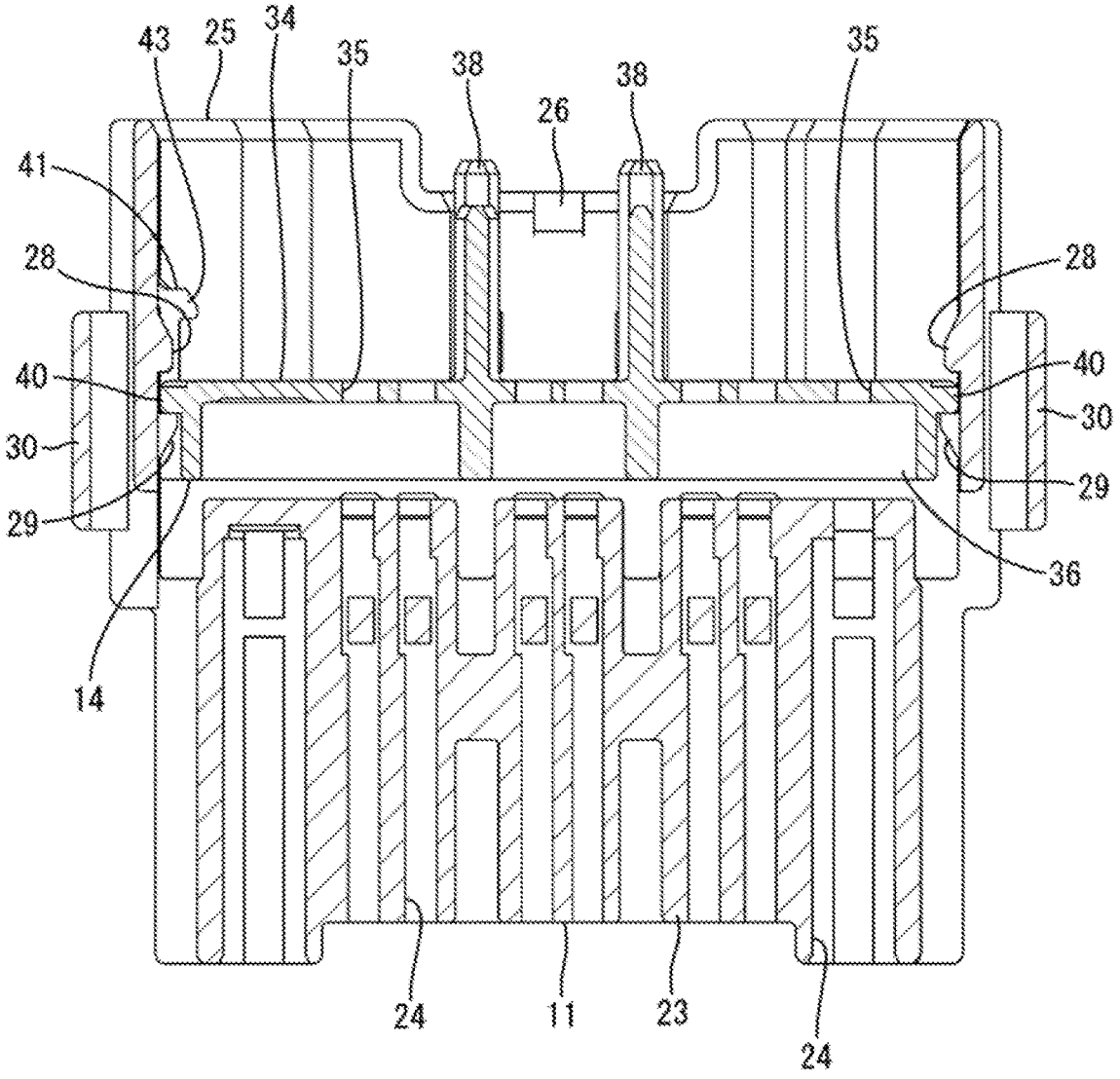
FIG. 12 is a section showing the state where the protection member is held at the partial locking position with respect to the male housing with the connector cut at different height positions on both left and right sides.

Further, as shown in FIG. 7, the protection member 14 includes a part projecting up from a laterally central part of the protection wall 34, and recesses 39 and stopped portions 40 shaped similarly to the above are provided on both left and right sides of the upper end of this projecting part. As shown in FIG. 12, the stopped portions 40 are sandwiched between the corresponding front and rear stopper portions 28, 29 at the partial locking position.

As shown in FIG. 7, the protection member 14 includes two hooked portions 41 on both left and right side edges of the protection wall 34. The right hooked portion 41 is on a lower part of the right side edge of the protection wall 34, and the left hooked portion 41 is on an upper part of the left side edge of the protection wall 34. Thus, the left and right hooked portions 41 are arranged on the left and right side edges of the protection wall 34 while being deviated in the vertical direction. Further, the right hooked portion 41 is below and side by side with the right recess 39 (same also applies to the stopped portion 40) on the right side edge of the protection wall 34. The left hooked portion 41 is above and side by side with the left recess 39 (same also applies to the stopped portion 40) on the left side edge of the protection wall 34.

As shown in FIG. 9, each hooked portion 41 includes an arm 42 projecting forward from the left and right sides of the front surface of the protection wall 34 and a claw-like body 43 projecting in from the inner surfaces of tip parts of the arms 42. Each arm 42 is deflectable and deformable inward and outward with base end parts connected to the front surface of the protection wall 34 as fulcrums. The front surface of the body 43 is inclined rearward toward a tip, and the rear surface of the body 43 is perpendicular to the front-rear direction.

Each hooked portion 41 includes a claw-like guiding portion 44 projecting obliquely toward an outer front side from an outer corner part of the tip part of the arm 42. That is, the guiding portion 44 projects toward a side opposite to the body 43 on the tip part of the arm 42. The tip surface (outer end surface) of the guiding portion 44 is straight along the front-rear direction. The rear surface of the guiding portion 44 is inclined forward toward the tip surface. The front surface of the guiding portion 44 also is inclined forward toward the tip surface. Specifically, the front surface of the guiding portion 44 forms a slope 45 projecting in an overhanging manner from the outer corner part to the tip surface of the arm 42. The slope 45 of the guiding portion 44 guides outward expansion (deflection) of the arm 42 by sliding against the slope 33 of the contact portion 31 (see FIG. 3).

Connection and Separation of Connector

Figure 11:
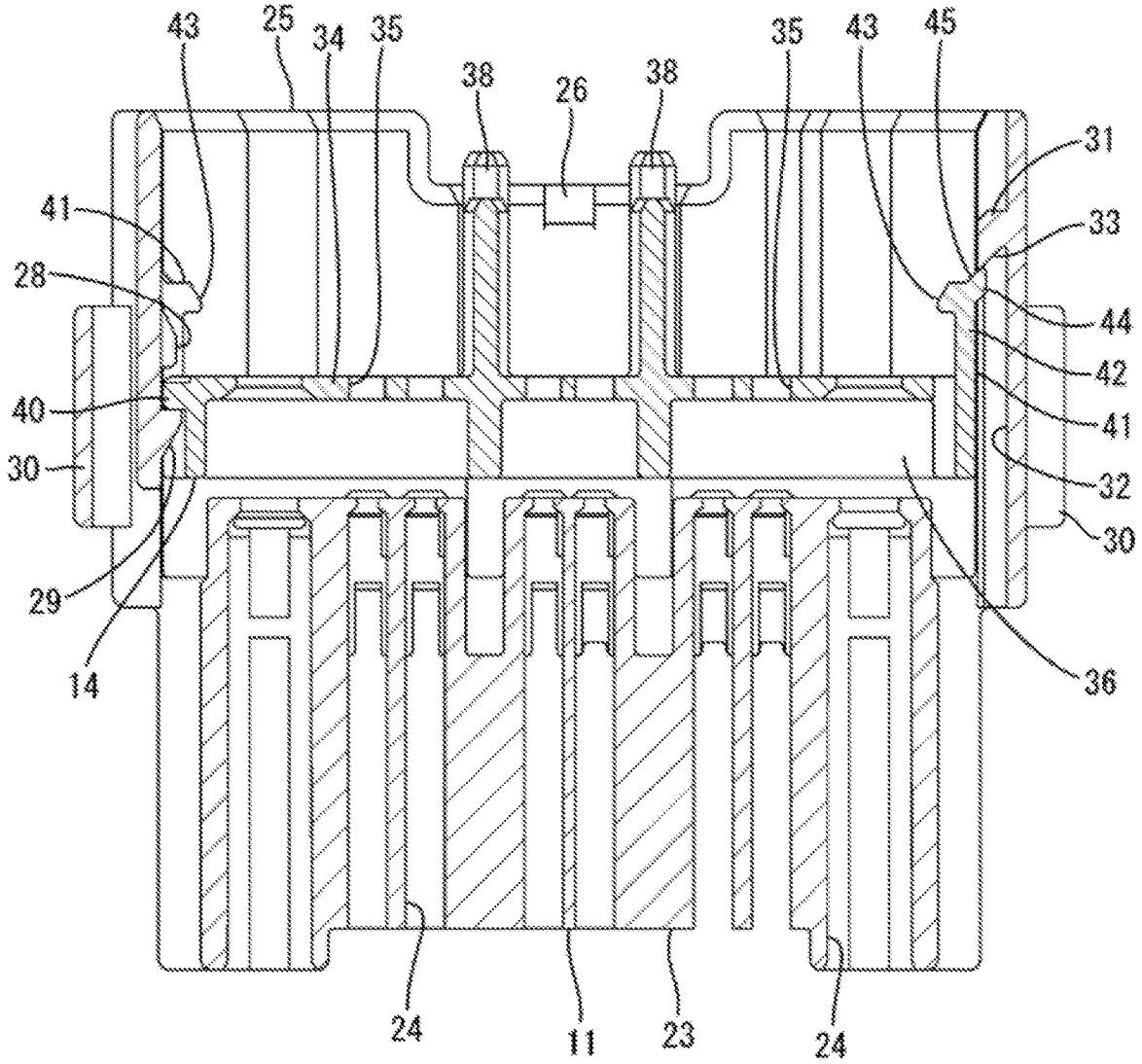
FIG. 11 is a section showing the state where the protection member is held at the partial locking position with respect to the male housing.

The protection member 14 is inserted into the receptacle 25 from the front and is arranged at the partial locking position. As shown in FIG. 11, at the partial locking position, the protection wall 34 is separated forward from the back surface of the receptacle 25 (front surface of the male housing body 23). The tip parts of the male tabs 15 of the respective male terminal fittings 12 are inserted into the respective positioning holes 35 to be protected (see FIG. 4).

The stopped portions 40 of the protection wall 34 are sandwiched between the corresponding front and rear stoppers 28, 29 after the deflecting portions 27 are deflected. In this way, the protection member 14 is held at the partial locking position with a movement restricted. Specifically, the stopped portions 40 contact the respective rear stoppers 29 to restrict movement of the protection member 14 toward the full locking position (back side of the receptacle 25). The contact of the stopped portions 40 with the respective front stoppers 28 restricts movement of the protection member 14 toward a side opposite to the full locking position, i.e. in an escaping direction from the receptacle 25.

In the process of assembling the protection member 14 at the partial locking position, the guiding portions 44 of the hooked portions 41 ride on the tip surfaces of the contact portions 31 and the arms 42 of the hooked portions 41 are deflected and deformed a little. When the protection member 14 reaches the partial locking position, the arms 42 of the hooked portions 41 resiliently return to a state where the slopes 45 of the guiding portions 44 of the hooked portions 41 can contact the slopes 33 of the contact portions 31.

Figure 3:
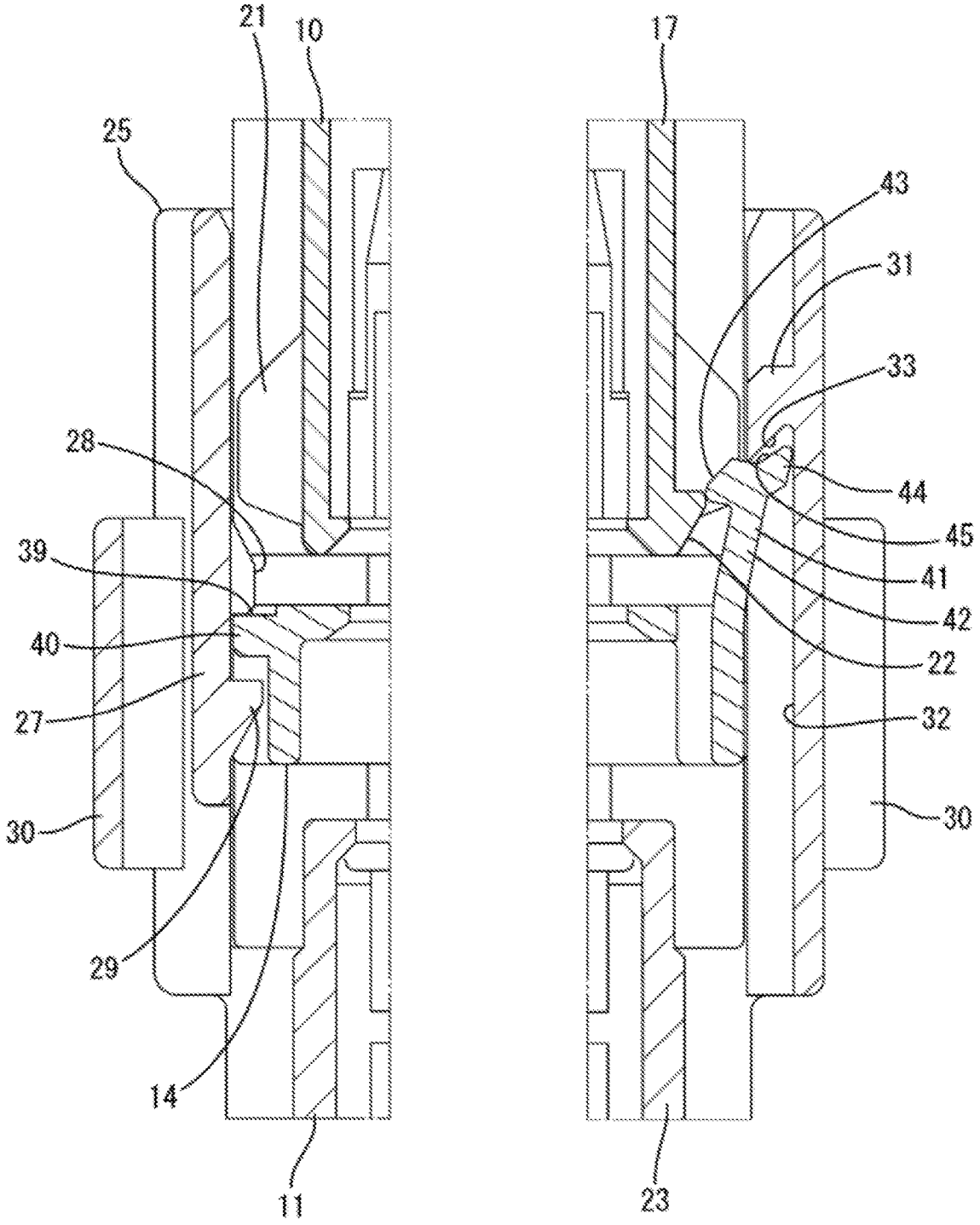
FIG. 3 is an enlarged section showing a state where the hooked portion is resiliently deformed by coming into contact with a contact portion and a state where a stopped portion is fit between front and rear stopper portions when the female housing further moves in the escaping direction from the receptacle from the state of FIG. 2.
Figure 4:
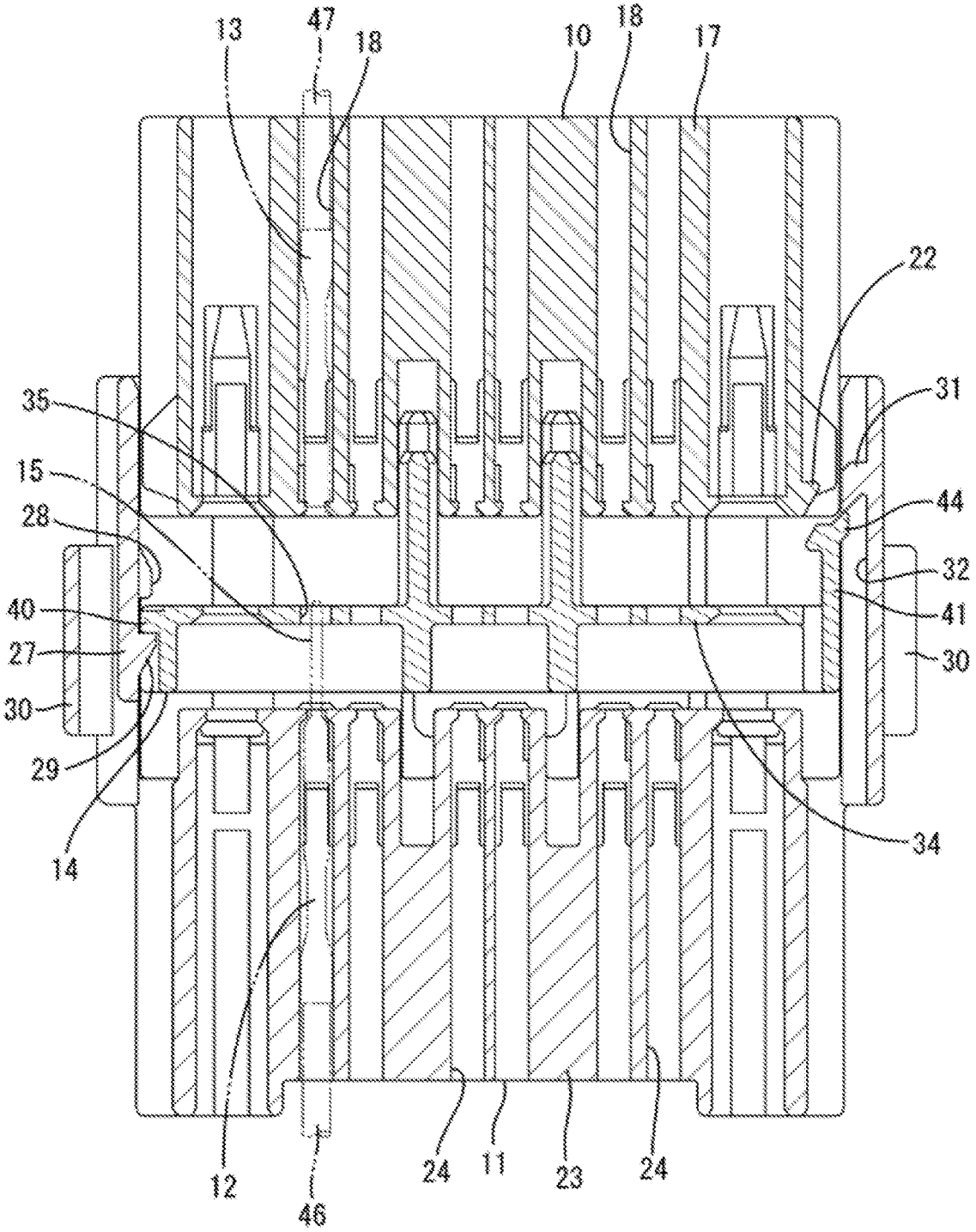
FIG. 4 is a section showing a state where a protection member is held at a partial locking position by maintaining the state where the hooked portion is in contact with the contact portion and the stopped portion is fit between the front and rear stopper portions when the female housing further moves in the escaping direction from the receptacle from the state of FIG. 3.

Subsequently, the female housing 10 is inserted into the receptacle 25 of the male housing 11. In the insertion process, the hooks 22 of the female housing 10 contact the bodies 43 of the hooked portions 41 and the arms 42 of the hooked portions 41 temporarily deflect and deform (see FIG. 3 although FIG. 3 is a view showing a separation process of the housings 10, 11 to be described later). Thereafter, the hooks 22 ride over the bodies 43 of the hooked portions 41 and the arms 42 of the hooked portions 41 resiliently return.

As the female housing 10 is inserted farther, the respective releasing portions 21 of the female housing 10 press the respective front stoppers 28 and the respective deflecting portions 27 are deflected and deformed outwardly (see FIG. 2 although FIG. 2 is a view showing the separation process of the housings 10, 11 to be described later). In this way, the stopped portions 40 are separated from the respective rear stoppers 29. As the female housing 10 is inserted farther, the protection wall 34 is pressed by the female housing 10 and the protection member 14 moves toward the full locking position. During this time, the peripheral wall 36 of the protection member 14 slides along the inner surface of the receptacle 25. Then, the releasing portions 21 ride over the respective front stoppers 28 and the deflecting portions 27 resiliently return.

When the female housing 10 is inserted to a proper depth into the receptacle 25 of the male housing 11, the lock arm 19 is locked resiliently to the lock 26 and the housings 10, 11 are held in a connected state. Then, the protection member 14 reaches the full locking position and, as shown in FIG. 11, the protection wall 34 is held sandwiched between the housings 10, 11. The male tabs 15 of the male terminal fittings 12 project into the respective female cavities 18 through the respective positioning holes 35 of the protection wall 34 and are inserted into the connecting portions 16 of the respective female terminal fittings 13 to be connected. When the protection member 14 is at the full locking position, tips (parts of the slope portions 45) of the guiding portions 44 of the hooked portions 41 are arranged in the grooves 32 of the receptacle 25. The bodies 43 of the hooked portions 41 are arranged in front of and at a distance from the hooks 22 so as to be able to come into contact with the hooks 22.

On the other hand, when the housings 10, 11 are separated for a certain reason, such as maintenance, a locked state of the lock arm 19 and the lock 26 is released and the female housing 10 is moved in the escaping direction from the receptacle 25. Then, the releasing portions 21 of the female housing 10 press the respective front stoppers 28 and the deflecting portions 27 are deflected and deformed outward (see FIG. 2).

In the process of moving the female housing 10 in the escaping direction from the receptacle 25, the hooks 22 contact the hooked portions 41 in the escaping direction (forward direction when viewed from the side of the female housing 10). The female housing 10 further moves and the state where the hooks 22 are in contact with (hooked to) the hooked portions 41 is maintained so that the protection member 14 also moves in the escaping direction from the receptacle 25 (forward direction when viewed from the protection member 14). During this time, the front stopper portions 28 ride on the tip surfaces of the respective releasing portions 21 and the deflected state of the deflecting portions 27 is maintained.

When the female housing 10 move farther, the slopes 45 of the guiding portions 44 of the hooked portions 41 contact the slopes 33 of the contact portions 31. As the female housing 10 moves farther, the slopes 45, 33 slide against each other and the hooked portions 41 are inserted deeply into the grooves 32 and incline toward the contact portions 31. During this time, hooking margins of the bodies 43 of the hooked portions 41 and the hooks 22 gradually decrease. When the arms 42 of the hooked portions 41 are deflected and deformed outward and the tips of the guiding portions 44 of the hooked portions 41 reach positions where these tips can contact the back surfaces of the grooves 32 in this way, the hooked state of the bodies 43 of the hooked portions 41 to the hooks 22 is released (see FIG. 3). In this way, the arms 42 of the hooked portions 41 resiliently return. Then, a state is entered where the tips of the guiding portions 44 of the hooked portions 41 can contact the sloped portions 33 of the contact portions 31 again (see FIG. 4). Therefore, the protection member 14 stops without moving together with the female housing 10.

Immediately before or simultaneously with the resilient return of the arms 42 of the both hooked portions 41, the front stopper portions 28 ride over the tips of the respective releasing portions 21 and the deflected state of the deflecting portions 27 is released. As the deflecting portions 27 resiliently return, the stopped portions 40 of the protection member 14 again are fit between the front and rear stoppers 28, 29. In this way, the protection member 14 is held at the partial locking position with a movement restricted (see FIG. 4).

As described above, if the female housing 10 moves in the escaping direction from the receptacle 25 when the housings 10, 11 are separated, the hooks 22 of the female housing 10 contact the bodies 43 of the hooked portions 41 of the protection member 14 and the protection member 14 can also move toward the partial locking position. Immediately before or as the protection member 14 reaches the partial locking position, the guiding portions 44 of the hooked portions 4 contact the contact portions 31, and the hooked portions 41 are deflected and deformed outward to separate from the hooks 22. The hooked portions 41 resiliently return to the state where the hooked portions 41 can contact the contact portions 31. In this way, the protection member 14 can be separated from the female housing 10 and stopped at the partial locking position. At the partial locking position, the stopped portions 40 are in contact with the respective front stopper portions 28, separately from the hooked portions 41, and the protection member 14 reliably is maintained in a state stopped at the partial locking position.

Further, the hooked portions 41 and the contact portions 31 have the slopes 45, 33 inclined to separate the hooked portions 41 from the hooks 22 with respect to a moving direction of the protection member 14 from the full locking position to the partial locking position. Thus, the hooked portions 41 are deflected and deformed along the slope portions 45, 33, and reliability and stability in separating the hooked portions 41 from the hooks 22 and keeping the protection member 14 at the partial locking position are enhanced.

Furthermore, the bodies 43 of the hooked portions 41 and the hooks 22 are formed to perpendicularly contact each other with respect to the front-rear direction. Thus, it is possible to reliably prevent inadvertent disengagement of the guiding portions 44 of the hooked portions 41 from the hooks 22 in the process of bringing the bodies 43 of the hooked portions 41 into contact with the contact portions 31 and deflecting and deforming the hooked portions 41.

Other Embodiments

The embodiment disclosed this time should be construed as illustrative rather than restrictive in all aspects.

Figure 13:
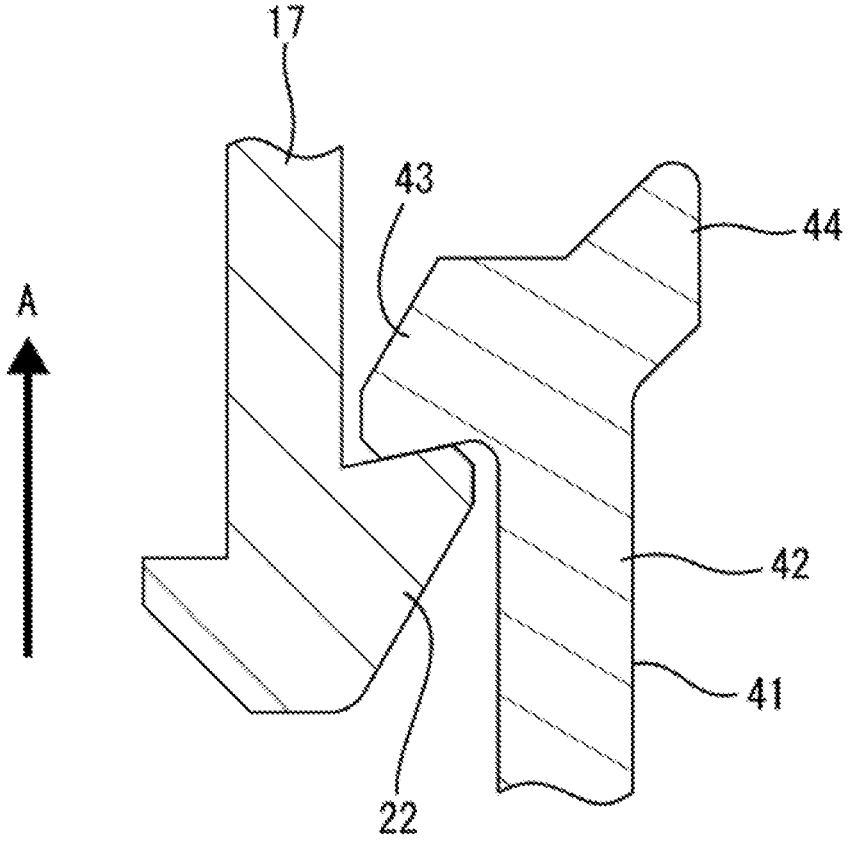
FIG. 13 is an enlarged section showing a state where a hooking portion and a hooked portion are in contact with each other along a direction at an acute angle to a front-rear direction in another embodiment.

For example, in the above embodiment, the hooked portions 41 and the hooks 22 are respectively formed to contact each other perpendicularly with respect to the moving direction of the protection member 14 from the full locking position to the partial locking position (forward direction in the above embodiment). However, as another embodiment, the hooked portions 41 and the hooks 22 may be formed to contact each other along a direction at an acute angle to the moving direction of the protection member 14 from the full locking position to the partial locking position (direction of an arrow A of FIG. 13), as shown in FIG. 13.

Although two hooked portions 41 are provided in the above embodiment, only one, three or more hooked portions 41 may be provided as another embodiment. Only one, three or more hooks 22 and contact portions 31 may also be provided to correspond to the hooking portion(s) 41.

LIST OF REFERENCE SIGNS

10 . . . female housing
11 . . . male housing
12 . . . male terminal fitting
13 . . . female terminal fitting
14 . . . protection member
15 . . . male tab
16 . . . connecting portion
17 . . . female housing body
18 . . . female cavity
19 . . . lock arm
20 . . . slit groove
21 . . . releasing portion
22 . . . hook
23 . . . male housing body
24 . . . male cavity
25 . . . receptacle
26 . . . lock
27 . . . deflecting portion
28 . . . front stopper
29 . . . rear stopper
30 . . . cover
31 . . . contact portion
32 . . . groove

33 . . . slope (of contact portion)
34 . . . peripheral wall
35 . . . positioning hole
36 . . . peripheral wall
37 . . . vertical rib
38 . . . projecting piece
39 . . . recess
40 . . . stopped portion
41 . . . hooked portion
42 . . . arm
43 . . . body
44 . . . guiding portion
45 . . . slope (of hooked portion)
46 . . . wire (connected to male terminal fitting)
47 . . . wire (connected to female terminal fitting)
48 . . . rib

What is claimed is:

1. A connector, comprising:

a male housing including a receptacle;

a male tab configured to project into the receptacle;

a protection member to be arranged in the receptacle; and a female housing to be inserted into the receptacle, wherein:

the protection member is movable to a partial locking position and a full locking position located more backward the receptacle than the partial locking position with the male tab positioned, the female housing includes a hook, the protection member includes a hooked portion capable contacting the hook in an escaping direction from the receptacle at the full locking position, the receptacle includes a contact portion capable of contacting the hooked portion in the escaping direction from the receptacle when the protection member is at the partial locking position, the protection member is movable from the full locking position to the partial locking position with the hooked portion held in contact with the hook, the protection member is stoppable at the partial locking position in a state where the hooked portion is in contact with the contact portion, the hooked portion and the contact portion include slopes inclined with respect to a moving direction of the protection member from the full locking position to the partial locking position, the slopes being capable of sliding against each other to deflect and deform the hooked portion in a direction separating the hooked portion from the hook.

2. The connector of claim 1, wherein the hooked portion and the hook are formed to contact each other perpendicularly with respect to a moving direction of the protection member from the full locking position to the partial locking position or along a direction at an acute angle to the moving direction.

3. The connector of claim 1, wherein the hooked portion that resiliently returns from the deflected and deformed state enters such a state as to be able to contact the contact portion.

4. The connector of claim 3, wherein:

the protection member includes a stopped portion, separately from the hooked portion, and the receptacle includes a stopper capable of contacting the stopped portion in the escaping direction of the protection member from the receptacle, separately from the contact portion.

5. The connector of claim 4, wherein the hooked portion and the hook are formed to contact each other perpendicularly with respect to a moving direction of the protection member from the full locking position to the partial locking position or along a direction at an acute angle to the moving direction.

6. A connector, comprising:

a male housing including a receptacle;

a male tab configured to project into the receptacle;

a protection member to be arranged in the receptacle; and a female housing to be inserted into the receptacle, wherein:

the protection member is movable to a partial locking position and a full locking position located more backward the receptacle than the partial locking position with the male tab positioned, the female housing includes a hook, the protection member includes a hooked portion capable contacting the hook in an escaping direction from the receptacle at the full locking position, the receptacle includes a contact portion capable of contacting the hooked portion in an escaping direction from the receptacle when the protection member is at the partial locking position, the protection member is movable from the full locking position to the partial locking position with the hooked portion held in contact with the hook, the protection member is stoppable at the partial locking position in a state where the hooked portion is in contact with the contact portion to be deflected and deformed in a direction separating from the hook, and the protection member includes a stopped portion, separately from the hooked portion, and the receptacle includes a stopper capable of contacting the stopped portion in the escaping direction of the protection member from the receptacle, separately from the contact portion.

7. The connector of claim 6, wherein the hooked portion that resiliently returns from the deflected and deformed state enters such a state as to be able to contact the contact portion.

* * * * *